US009058777B2

(12) United States Patent
Cao

(10) Patent No.: US 9,058,777 B2
(45) Date of Patent: Jun. 16, 2015

(54) LED BACKLIGHT DRIVING CIRCUIT AND LIQUID CRYSTAL DEVICE

(71) Applicant: Shenzhen China Star Optoelectronics Technology Co., Ltd., Shenzhen, Guangdong (CN)

(72) Inventor: Dan Cao, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/006,316

(22) PCT Filed: Aug. 1, 2013

(86) PCT No.: PCT/CN2013/080597

§ 371 (c)(1),
(2) Date: Sep. 20, 2013

(87) PCT Pub. No.: WO2015/010346

PCT Pub. Date: Jan. 29, 2015

(65) Prior Publication Data

US 2015/0028756 A1 Jan. 29, 2015

(51) Int. Cl.

| | |
|---|---|
| ***H05B 37/00*** | (2006.01) |
| ***H05B 39/00*** | (2006.01) |
| ***H05B 41/00*** | (2006.01) |
| ***G09G 3/34*** | (2006.01) |
| ***H05B 33/08*** | (2006.01) |

(52) U.S. Cl.
CPC ..... *G09G 3/3406* (2013.01); *H05B 33/0809* (2013.01)

(58) Field of Classification Search
None
See application file for complete search history.

(56) References Cited

U.S. PATENT DOCUMENTS

2010/0141163 A1* 6/2010 Ye et al. ..... 315/189

* cited by examiner

*Primary Examiner* — Jany Richardson
(74) *Attorney, Agent, or Firm* — Andrew C. Cheng

(57) ABSTRACT

A LED backlight driving circuit is disclosed. The driving circuit includes a boost circuit for converting an input voltage to a needed output voltage and for providing the output voltage to at least one LED strings, a follower circuit connecting to a negative end of the LED string, and a reference voltage module connecting to a reference voltage and the follower circuit. The follower circuit is for detecting a negative end voltage of the LED string and for generating a follower voltage according to the negative end voltage. The follower voltage couples with a reference voltage module. The reference voltage module adjusts the output voltage according to the follower voltage generated by the follower circuit. The output voltage is adjusted in accordance with the voltage drop of the LED string. In addition, a liquid crystal device including the LED backlight driving circuit is also disclosed.

12 Claims, 3 Drawing Sheets

LED BACKLIGHT DRIVING CIRCUIT AND LIQUID CRYSTAL DEVICE

BACKGROUND OF THE INVENTION

1. Field of the Invention

The present disclosure relates to a LED backlight driving circuit technology, and more particularly to a LED backlight driving circuit for adjusting an output voltage and the liquid crystal device (LCD) with the same.

2. Discussion of the Related Art

With the technology revolution, backlight technology of LCDs are developed. Typical LCDs adopt cold cathode fluorescent lamps (CCFL) as the backlight. However, as the CCFL backlight is characterized by attributes including low color reduction ability, low lighting efficiency, high discharging voltage, bad discharging characteristics in low temperature, and also, the CCFL needs a long time to achieve a stable gray scale. As such, LED is a new developed backlight technology.

Generally, LED backlight is arranged opposite to liquid crystal panels in LCDs so as to provide light sources to the liquid crystal panels. The LED backlight includes at least one LED string having a plurality of LED serially connected. In the manufacturing process or assembling process of the LED backlight, the voltage applied to the LED string may be smaller than a default value due to inaccuracy.

FIG. 1 is a circuit diagram of a driving circuit of a conventional LED backlight of LCD. As shown in FIG. 1, the LED backlight driving circuit includes a boost circuit 110, at least one LED string 120, a reference voltage module 130, and a voltage control module 150. The boost circuit 110 is controlled by the voltage control module 150 to convert the input voltage to a needed output voltage so as to provide the output voltage to the LED string 120. When the driving voltage remains unchanged, if the voltage of the LED string 120 is larger than a normal range, the voltage drop of the LED string 120 is too large. The driving voltage may be smaller than the voltage of the LED string 120, which results in a LED string 120 malfunction, if the driving voltage has not been adjusted. On the other hand, the driving voltage may be larger than the voltage of the LED string 120 and the voltage drop of the LED string 120 is too small if the driving voltage has not been adjusted. Under the circumstance, the voltage of the negative end of the LED string 120 is too large, and the power consumption increases. It is obvious the driving circuit is not capable of adjusting the output voltage in accordance with the voltage drop of the LED string 120.

SUMMARY

In order to overcome the above problems, the driving circuit of the claimed invention adjusts the output voltage in accordance with the voltage drop of the LED string so as to provide appropriate driving voltage for the LEDs.

In one aspect, a LED backlight driving circuit, comprising: a boost circuit for converting an input voltage to a needed output voltage and for providing the output voltage to at least one LED strings; a follower circuit connecting to a negative end of the LED string, the follower circuit configured for monitoring a negative end voltage of the LED string and for generating a follower voltage according to the negative end voltage, and the follower voltage couples with a reference voltage module; and the reference voltage module connecting to a reference voltage and the follower circuit, and the reference voltage module adjusts the output voltage according to the follower voltage generated by the follower circuit.

Wherein the follower circuit generates a first follower voltage coupling with the reference voltage module upon detecting that the negative end voltage of the LED string is smaller than a standard value, and the reference voltage module increases the output voltage according to the first follower voltage generated by the follower circuit, and the follower circuit generates a second follower voltage coupling with the reference voltage module upon detecting that the negative end voltage of the LED string is larger than the standard value, and the reference voltage module decreases the output voltage according to the second follower voltage generated by the follower circuit.

Wherein the follower circuit comprises a comparison circuit and a voltage control circuit, the comparison circuit is for detecting the negative end voltage of the LED string and for generating a control signal, and the voltage control circuit is for generating the follower voltage according to the control signal, and the follower voltage couples with the reference voltage module.

Wherein the comparison circuit comprises a first comparator and a second comparator, wherein an inversed input of the first comparator receives a first reference voltage, an non-inverting input of the second comparator receives a second reference voltage, the non-inverting input of the first comparator connects to the inversed input of the second comparator and then connects to the negative end of the LED string, output ends of the first comparator and the second comparator generate signals for controlling the voltage control circuit to generate the follower circuit coupling with the reference voltage module, and wherein the first reference voltage is larger than the second reference voltage.

Wherein the voltage control circuit comprises a first field effect transistor (FET) and a second FET, wherein gates of the first FET and the second FET respectively connects to the comparison circuit so as to be turn on or off according to the control signals generated by the comparison circuit, a drain of the first FET receives a third reference voltage, the drain of the second FET receives a fourth reference voltage, the sources of the first FET and the second FET respectively connects to a sixth resistor and a seventh resistor and then are interconnected to form the output ends of the voltage control circuit coupling with the reference voltage module, and wherein the third reference voltage is larger than the reference voltage, and the reference voltage is larger than the fourth reference voltage.

Wherein the voltage control circuit comprises a first FET and a second FET, wherein the gate of the first FET connects to the output end of the first comparator so as to be turn on or off by the signals output from the first comparator, the gate of the second FET connects to the output end of the second comparator so as to be turn on or off by the signals output from the second comparator, a drain of the first FET receives the third reference voltage, the drain of the second FET receives the fourth reference voltage, the sources of the first FET and the second FET respectively connects to the sixth resistor and the seventh resistor, and then are interconnected to form the output ends of the voltage control circuit coupling with the reference voltage module, and wherein the third reference voltage is larger than the reference voltage, and the reference voltage is larger than the fourth reference voltage.

Wherein the reference voltage module comprises a fourth resistor and a fifth resistor serially connected, one end of the fourth resistor connects to an output end of the boost circuit, and the other end of the fourth resistor connects to one end of the fifth resistor, the other end of the fifth resistor is electrically grounded, and a reference voltage connects between the fourth resistor and the fifth resistor to cooperatively operates with the fourth resistor and the fifth resistor so as to adjust the output voltage.

Wherein the fourth resistor and/or the fifth resistor are adjustable resistors.

Wherein the LED backlight driving circuit further comprises a voltage control module for controlling the boost circuit such that the boost circuit converts the input voltage to the needed output voltage to be provided to the LED string, and the LED string is driven by a constant current.

In another aspect, a liquid crystal device comprising a LED backlight source. The LED backlight source includes the above LED backlight driving circuit.

In view of the above, the claimed invention relates to detecting the negative end voltage of the LED string and determining if the voltage drop of the LED string is larger than or smaller than the standard value. When the voltage drop of the LED string is larger than the standard value, the follower circuit generates the first follower voltage coupling with the reference voltage module. The reference voltage module increases the output voltage Vout according to the first follower voltage. When the voltage drop of the LED string is smaller than the standard value, the follower circuit generates the second follower voltage coupling with the reference voltage module. The reference voltage module decreases the output voltage Vout according to the second follower voltage. In this way, the output voltage Vout is adjusted according to the voltage drop of the LED string so as to provide the appropriate voltage for the LEDs.

DETAILED DESCRIPTION OF THE EMBODIMENTS

Embodiments of the invention will now be described more fully hereinafter with reference to the accompanying drawings, in which embodiments of the invention are shown.

Figure 1:
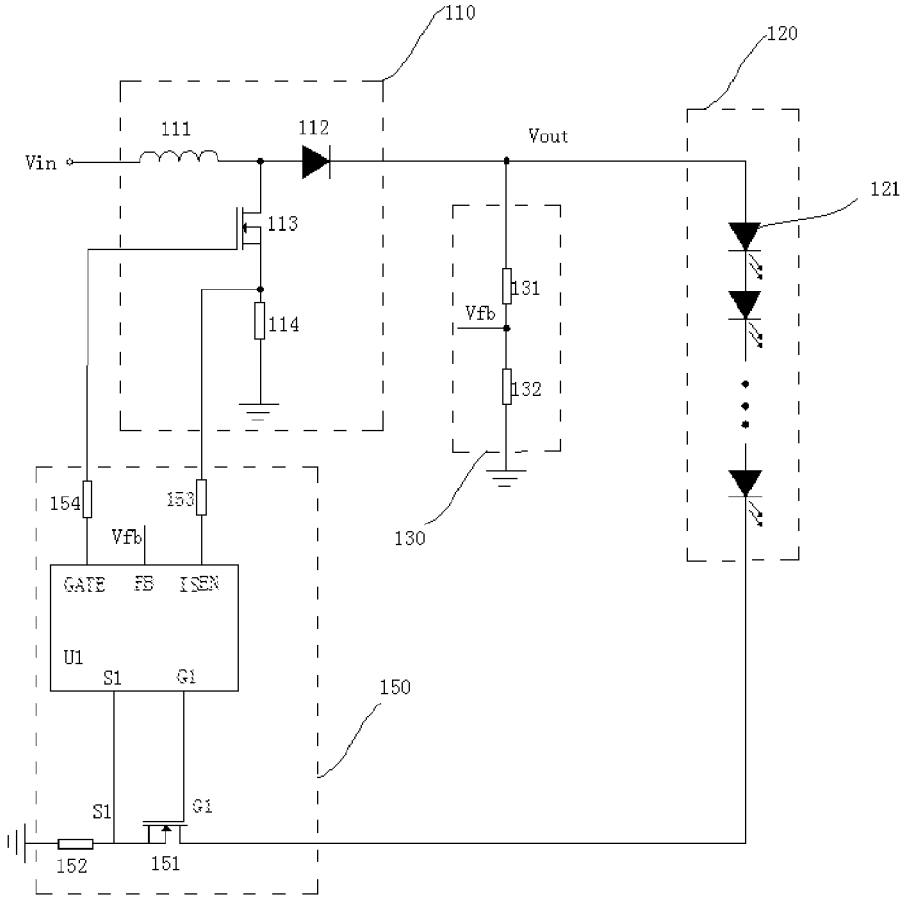
FIG. 1 (Prior Art)
FIG. 1 is a circuit diagram of a driving circuit of a conventional LED backlight of LCD.
Figure 2:
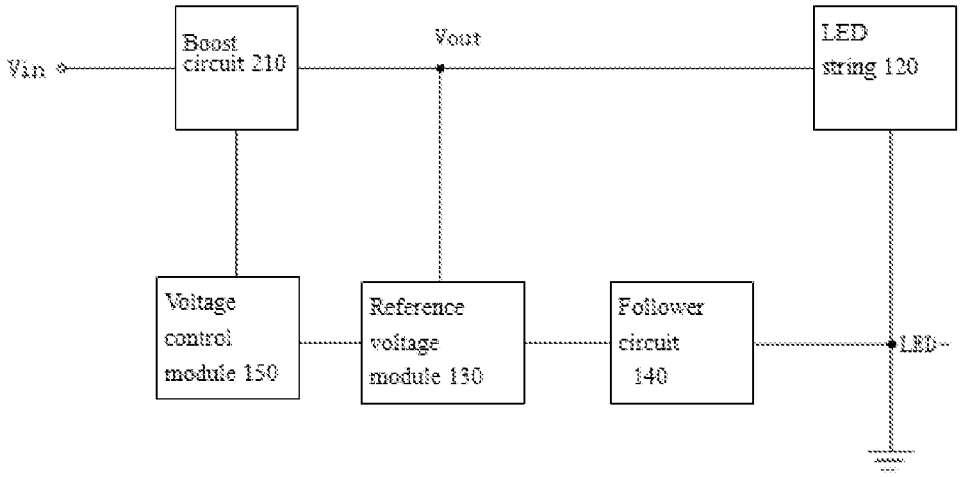
FIG. 2 is a schematic view showing the modules of the LED backlight driving circuit in accordance with one embodiment.

FIG. 2 is a schematic view showing the modules of the LED backlight driving circuit source in accordance with one embodiment.

As shown in FIG. 2, the LED backlight driving circuit includes a boost circuit 110 for converting an input voltage Vin to a needed output voltage Vout and for providing the output voltage Vout to the LED string 120, a follower circuit 140 connecting to a negative end of the LED string 120, and a reference voltage module 130 connecting to a reference voltage Vfb. The follower circuit 140 is for monitoring the negative end voltage of the LED string 120 and for generating a follower voltage according to the negative end voltage, and the follower voltage couples with the reference voltage module 130. The reference voltage module 130 connects with the follower circuit 140. The reference voltage module 130 adjusts the output voltage Vout according to the follower voltage generated by the follower circuit 140.

Upon detecting that a negative end voltage of the LED string 120 is smaller than a standard value, i.e., the voltage drop of the LED string 120 is smaller than the standard value, the follower circuit 140 generates a first follower voltage coupling with the reference voltage module 130. The reference voltage module 130 increases the output voltage Vout according to the first follower voltage generated by the follower circuit 140. Upon detecting that the negative end voltage of the LED string 120 is larger than the standard value, i.e., the voltage drop of the LED string 120 is larger than the standard value, the follower circuit 140 generates a second follower voltage coupling with the reference voltage module 130. The reference voltage module 130 decreases the output voltage Vout according to the second follower voltage generated by the follower circuit 140.

It can be understood that the claimed invention is capable of adjusting the output voltage Vout according to the negative end voltage of the LED string 120, that is, the voltage drop of the LED string 120. In this way, the output voltage Vout is adjusted according to negative end voltage of the LED string 120 so as to provide the appropriate voltage to the LED string 120.

As shown in FIG. 2, the LED backlight driving circuit also includes a voltage control module 150 for controlling the boost circuit 110 such that the boost circuit 110 converts the input voltage Vin to the needed output voltage Vout. The output voltage Vout is provided to the LED string 120 such that the LED string 120 is driven by a constant current.

Figure 3:
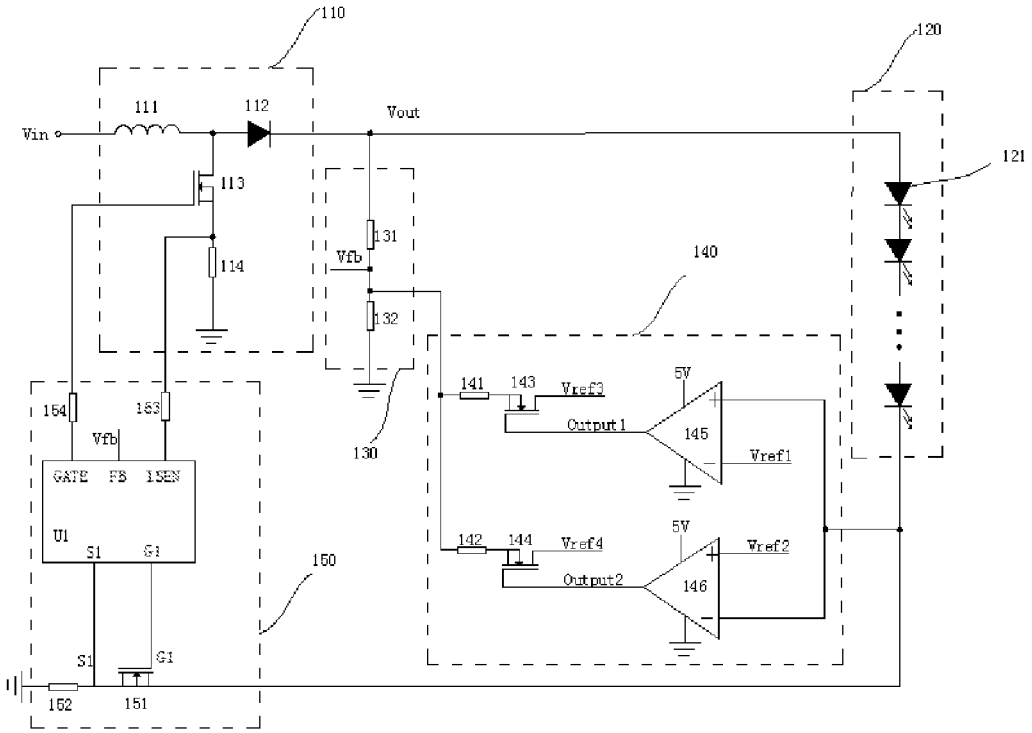
FIG. 3 is a circuit diagram of the LED backlight driving circuit in accordance with one embodiment.

FIG. 3 is a circuit diagram of the LED backlight driving circuit in accordance with one embodiment.

In the embodiment, the LED backlight driving circuit includes the boost circuit 110, the LED string 120, the reference voltage module 130, the follower circuit 140, and the voltage control module 150.

The boost circuit 110 includes an inductor 111, a rectifier diode 112, a third field effect transistor (FET) 113, and a first resistor 114. One end of the inductor 111 receives the direct current (DC) voltage Vin, and the other end of the inductor 111 connects to a positive end of the rectifier diode 112 and a drain of the third FET 113. A gate of the third FET 113 connects to the voltage control module 150 so as to be turn on or off when being controlled by the voltage control module 150. A source of the third FET 113 is electrically grounded via the first resistor 114. A negative end of the rectifier diode 112 operates as an output end of the boost circuit 110 and connects to the LED string 120.

The voltage control module 150 includes a control chip U1, a fourth FET 151, and an eighth resistor 152. The drain of the fourth FET 151 connects to the negative end of the LED string 120. The source of the fourth FET 151 connects to one end of the eighth resistor 152, and the other end of the eighth resistor 152 is electrically grounded. The control chip U1 connects to the source of the fourth FET 151 via a pin S1 to detect the voltage of the eighth resistor 152. The control chip U1 connects to the gate of the fourth FET 151 via the pin G1 to turn on or off the fourth FET 151. The control chip U1 connects to the source of the third FET 113 of the boost circuit 110 via the pin ISEN to detect the current passing the source of the third FET 113. The control chip U1 connects to the gate of the third FET 113 via the pin GATE to turn on or off the third FET 113 by the control signals generated by the pin GATE. The control chip U1 connects to a connecting end of the reference voltage Vfb of the reference voltage module 130 via the pin FB. The control chip U1 generates the control signals in accordance with the detected voltage of the eighth resistor 152, the current passing the source of the third FET 113, and the voltage change of the connecting end of the reference voltage Vfb.

The control signals are adopted to turn on or off the third FET 113 via the pin GATE. Furthermore, the control signals are adopted to control the boost circuit 110 such that the boost circuit 110 converts the input signals Vin to the needed output voltage Vout to the LED string 120. As such, the LED string 120 can be driven by the constant current.

The reference voltage module 130 includes a fourth resistor 131 (R4) and a fifth resistor 132 that are serially connected. One end of the fourth resistor 131 connects to the negative end of the rectifier diode 112, and the other end of the fourth resistor 131 connects to one end of the fifth resistor 132. The other end of the fifth resistor 132 is electrically grounded. In addition, the reference voltage Vfb connects between the fourth resistor 131 and the fifth resistor 132 to cooperatively operates with the fourth resistor 131 and the fifth resistor 132 such that the output voltage Vout can be adjusted. In addition, the connecting end of the reference voltage Vfb between the fourth resistor 131 and the fifth resistor 132 further connects to the pin FB of the control chip U1.

Preferably, the fourth resistor 131 and/or the fifth resistor 132 are adjustable resistors.

Figure 4:
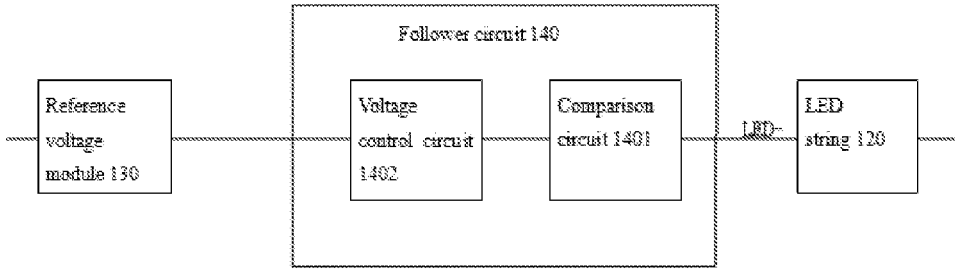
FIG. 4 is a schematic view showing the modules of the follower circuit in accordance with one embodiment.
Figure 5:
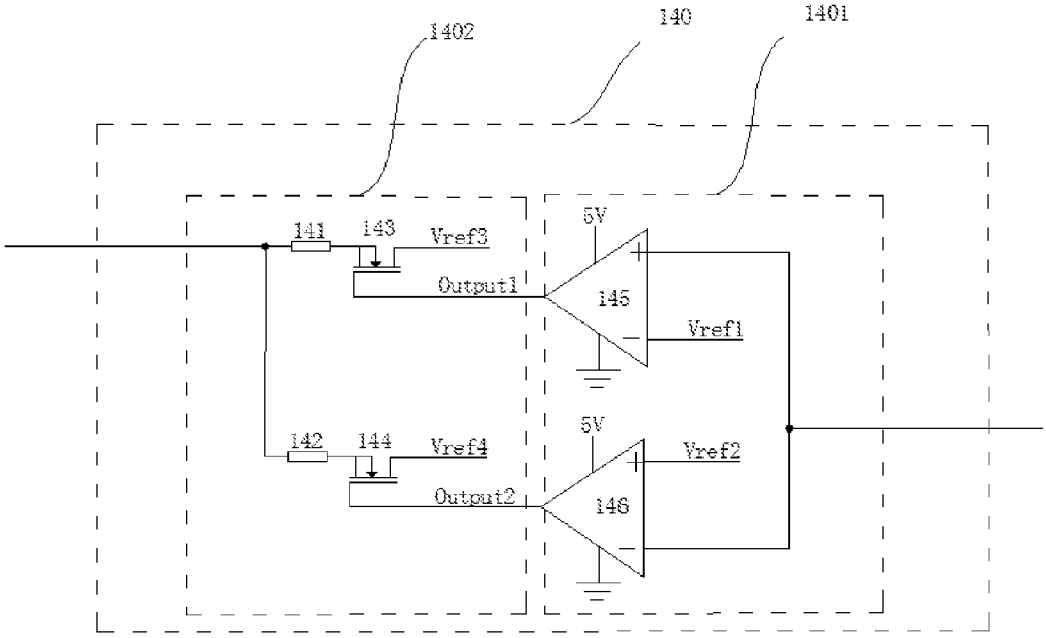
FIG. 5 is a circuit diagram of the follower circuit in accordance with one embodiment.

As stated above, the follower circuit 140 detects the negative end voltage of the LED string 120 and generates the follower voltage according to the negative end voltage. The follower voltage couples with the reference voltage module 130 such that the output voltage Vout may be adjusted by the voltage drop of the LED string 120 and the appropriate driving voltage is provided to the LED string 120. FIG. 4 is a schematic view showing the modules of the follower circuit in accordance with one embodiment. The circuit diagram of the follower circuit 140 is shown in FIG. 5. The follower circuit 140 includes a comparison circuit 1401 and a voltage control circuit 1402. The comparison circuit 1401 includes a first comparator 145 and a second comparator 146. The voltage control circuit 1402 includes a first FET 143 and a second FET 144. An inversed input (−) of the first comparator 145 receives a reference voltage Vref1. An non-inverting input (+) of the second comparator 146 receives the reference voltage Vref2. The non-inverting input (+) of the first comparator 145 connects to the inversed input (−) of the second comparator 146 and then connects to the negative end of the LED string 120. The output end of the first comparator 145 connects to the gate of the first FET 143. The first FET 143 is turn on or off by the output signals Output1 of the first comparator 145. The output end of the second comparator 146 connects to the gate of the second FET 144 so as to turn on or off the second FET 144 by the output signals Output2 of the second comparator 146. The drain of the first FET 143 receives the reference voltage Vref3. The gate of the first FET 143 connects between the fourth resistor 131 and the fifth resistor 132 of the reference voltage module 130 via a sixth resistor 141 (R6). The drain of the second FET 144 receives the reference voltage Vref4. The source of the second FET 144 connects between the fourth resistor 131 and the fifth resistor 132 of the reference voltage module 130 via a seventh resistor 142 (R7). It is to be noted that Vref1>Vref2, and Vref3>Vfb>Vref4.

In the embodiment, the LED string 120 includes at least one LED 121.

The operation process of the LED backlight driving circuit of FIG. 3 will be described hereinafter.

(a): When the voltage of the LED string 120 is within a normal range, which means the voltage drop of the LED string 120 is normal, the relationship of the negative end voltage (LED-) of the LED string 120, the reference voltage Vref1 and the Vref2 satisfies the following equation: Vref1>LED−>Vref2. At this moment, the output signals Output1 of the first comparator 145 is at low level, and the second FET 144 is turn off. The output voltage Vout is not affected by the follower circuit 140. The output voltage Vout satisfies the following equation:

$$Vout = Vfb * \frac{R4}{R5} + Vfb;$$

(b): When the voltage of the LED string 120 is larger than the normal range, which means the voltage drop of the LED string 120 is too large, the output voltage Vout may be smaller than the voltage of the LED string 120. As such, the LED string 120 may be malfunction. After connecting to the follower circuit 140, the relationship of the negative end voltage (LED-) of the LED string 120, the reference voltage Vref1 and the Vref2 satisfies the following equation: Vref1>Vref1>LED. At this moment, the output signals Output1 of the first comparator 145 is at low level and the first FET 143 is turn off. The output signals Output2 of the second comparator 146 is at high level, and the second FET 144 is turn on. The follower circuit 140 couples the reference voltage Vref4, which connects with the drain of the second FET 144, with the reference voltage module 130. In addition, as Vfb is larger than Vref4, the output voltage is calculated by the equation:

$$Vout = Vfb * \frac{R4}{R5} + Vfb + (Vfb - Vref4) * \frac{R4}{R6};$$

That is, when the voltage drop of the LED string 120 is too large, the output voltage Vout is prevented from being smaller than the voltage of the LED string 120 by increasing the output voltage Vout by the follower circuit 140.

(c): When the voltage of the LED string 120 is smaller than the normal range, which means the voltage drop of the LED string 120 is too small, the output voltage Vout may be larger than the voltage of the LED string 120 if the output voltage Vout is not adjusted, which may results in that the negative end voltage of the LED string 120 is too high and the power consumption increases. After connecting to the follower circuit 140, the relationship of the negative end voltage (LED-) of the LED string 120, the reference voltage Vref1 and the Vref2 satisfies the following equation: LED.>Vref1>Vref2. At this moment, the output signals Output1 of the first comparator 145 is at high level, and the first FET 143 is turn on. The output signals Output2 of the second comparator 146 is at low level and the second FET 144 is turn off. The follower circuit 140 couples the reference voltage Vref3, which connects with the drain of the first FET 143, with the reference voltage module 130. In addition, as Vref3 is larger than Vfb, the output voltage is calculated by the equation:

$$Vout = Vfb * \frac{R4}{R5} + Vfb - (Vref3 - Vfb) * \frac{R4}{R7};$$

That is, when the voltage drop of the LED string 120 is too small, the output voltage Vout is prevented from being larger than the voltage of the LED string 120 by decreasing the output voltage Vout by the follower circuit 140.

In view of the above, the claimed invention relates to detecting the negative end voltage of the LED string and determining if the voltage drop of the LED string is larger than or smaller than the standard value. When the voltage drop of the LED string is larger than the standard value, the follower circuit generates the first follower voltage coupling with the reference voltage module. The reference voltage module increases the output voltage Vout according to the first follower voltage. When the voltage drop of the LED string is smaller than the standard value, the follower circuit generates the second follower voltage coupling with the reference voltage module. The reference voltage module decreases the output voltage Vout according to the second follower voltage. In this way, the output voltage Vout is adjusted according to the voltage drop of the LED string so as to provide the appropriate voltage for the LEDs.

It should be noted that relational terms such as "first" and "second" are only used to differ an entity or operation from another entity or operation in this specification, and do not require or imply any real relationship or sequence among these entities or operations. Furthermore, terms "include", "contain" or any of their derivatives are intended to convey a non-exclusive connotation, so that a process, a method, an article or a device including a series of elements not only includes such elements, but also includes other elements that are not listed explicitly, or further includes inherent elements of the process, the method, the article or the device. If no more limitations are made, an element limited by "include a/an . . . " does not exclude another same element existing in the process, the method, the article, or the device that includes the element.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A LED backlight driving circuit, comprising:

a boost circuit for converting an input voltage to a needed output voltage and for providing the output voltage to at least one LED strings;

a follower circuit connecting to a negative end of the LED string, the follower circuit configured for monitoring a negative end voltage of the LED string and for generating a follower voltage according to the negative end voltage, and the follower voltage couples with a reference voltage module; and the reference voltage module connecting to a reference voltage and the follower circuit, and the reference voltage module adjusts the output voltage according to the follower voltage generated by the follower circuit;

wherein the follower circuit generates a first follower voltage coupling with the reference voltage module upon detecting that the negative end voltage of the LED string is smaller than a standard value, and the reference voltage module increases the output voltage according to the first follower voltage generated by the follower circuit, and the follower circuit generates a second follower voltage coupling with the reference voltage module upon detecting that the negative end voltage of the LED string is larger than the standard value, and the reference voltage module decreases the output voltage according to the second follower voltage generated by the follower circuit;

the follower circuit comprises a comparison circuit and a voltage control circuit, the comparison circuit is for detecting the negative end voltage of the LED string and for generating a control signal, and the voltage control circuit is for generating the follower voltage according to the control signal, and the follower voltage couples with the reference voltage module; and the comparison circuit comprises a first comparator and a second comparator, wherein an inversed input of the first comparator receives a first reference voltage, an non-inverting input of the second comparator receives a second reference voltage, the non-inverting input of the first comparator connects to the inversed input of the second comparator and then connects to the negative end of the LED string, output ends of the first comparator and the second comparator generate signals for controlling the voltage control circuit to generate the follower circuit coupling with the reference voltage module, and wherein the first reference voltage is larger than the second reference voltage.

2. The LED backlight driving circuit as claimed in claim 1, wherein the voltage control circuit comprises a first field effect transistor (FET) and a second FET, wherein gates of the first FET and the second FET respectively connects to the comparison circuit so as to be turn on or off according to the control signals generated by the comparison circuit, a drain of the first FET receives a third reference voltage, the drain of the second FET receives a fourth reference voltage, the sources of the first FET and the second FET respectively connects to a sixth resistor and a seventh resistor and then are interconnected to form the output ends of the voltage control circuit coupling with the reference voltage module, and wherein the third reference voltage is larger than the reference voltage, and the reference voltage is larger than the fourth reference voltage.

3. The LED backlight driving circuit as claimed in claim 1, wherein the voltage control circuit comprises a first FET and a second FET, wherein the gate of the first FET connects to the output end of the first comparator so as to be turn on or off by the signals output from the first comparator, the gate of the second FET connects to the output end of the second comparator so as to be turn on or off by the signals output from the second comparator, a drain of the first FET receives the third reference voltage, the drain of the second FET receives the fourth reference voltage, the sources of the first FET and the second FET respectively connects to the sixth resistor and the seventh resistor, and then are interconnected to form the output ends of the voltage control circuit coupling with the reference voltage module, and wherein the third reference voltage is larger than the reference voltage, and the reference voltage is larger than the fourth reference voltage.

4. The LED backlight driving circuit as claimed in claim 1, wherein the reference voltage module comprises a fourth resistor and a fifth resistor serially connected, one end of the fourth resistor connects to an output end of the boost circuit, and the other end of the fourth resistor connects to one end of the fifth resistor, the other end of the fifth resistor is electrically grounded, and a reference voltage connects between the fourth resistor and the fifth resistor to cooperatively operates with the fourth resistor and the fifth resistor so as to adjust the output voltage.

5. The LED backlight driving circuit as claimed in claim 4, wherein the fourth resistor and/or the fifth resistor are adjustable resistors.

6. The LED backlight driving circuit as claimed in claim 1, wherein the LED backlight driving circuit further comprises a voltage control module for controlling the boost circuit such that the boost circuit converts the input voltage to the needed output voltage to be provided to the LED string, and the LED string is driven by a constant current.

7. A liquid crystal device comprising a LED backlight source, the LED backlight source having a LED backlight driving circuit, the driving circuit comprising:

a boost circuit for converting an input voltage to a needed output voltage and for providing the output voltage to at least one LED strings;

a follower circuit connecting to a negative end of the LED string, the follower circuit configured for monitoring a negative end voltage of the LED string and for generating a follower voltage according to the negative end voltage, and the follower voltage couples with a reference voltage module; and the reference voltage module connecting to a reference voltage and the follower circuit, and the reference voltage module adjusts the output voltage according to the follower voltage generated by the follower circuit;

wherein the follower circuit generates a first follower voltage coupling with the reference voltage module upon detecting that the negative end voltage of the LED string is smaller than a standard value, and the reference voltage module increases the output voltage according to the first follower voltage generated by the follower circuit, and the follower circuit generates a second follower voltage coupling with the reference voltage module upon detecting that the negative end voltage of the LED string is larger than the standard value, and the reference voltage module decreases the output voltage according to the second follower voltage generated by the follower circuit;

the follower circuit comprises a comparison circuit and a voltage control circuit, the comparison circuit is for detecting the negative end voltage of the LED string and for generating a control signal, and the voltage control circuit is for generating the follower voltage according to the control signal, and the follower voltage couples with the reference voltage module; and wherein the comparison circuit comprises a first comparator and a second comparator, wherein an inversed input of the first comparator receives a first reference voltage, an non-inverting input of the second comparator receives a second reference voltage, the non-inverting input of the first comparator connects to the inversed input of the second comparator and then connects to the negative end of the LED string, output ends of the first comparator and the second comparator generate signals for controlling the voltage control circuit to generate the follower circuit coupling with the reference voltage module, and wherein the first reference voltage is larger than the second reference voltage.

8. The liquid crystal device as claimed in claim 7, wherein the voltage control circuit comprises a first field effect transistor (FET) and a second FET, wherein gates of the first FET and the second FET respectively connects to the comparison circuit so as to be turn on or off according to the control signals generated by the comparison circuit, a drain of the first FET receives a third reference voltage, the drain of the second FET receives a fourth reference voltage, the sources of the first FET and the second FET respectively connects to a sixth resistor and a seventh resistor and then are interconnected to form the output ends of the voltage control circuit coupling with the reference voltage module, and wherein the third reference voltage is larger than the reference voltage, and the reference voltage is larger than the fourth reference voltage.

9. The liquid crystal device as claimed in claim 7, wherein the voltage control circuit comprises a first FET and a second FET, wherein the gate of the first FET connects to the output end of the first comparator so as to be turn on or off by the signals output from the first comparator, the gate of the second FET connects to the output end of the second comparator so as to be turn on or off by the signals output from the second comparator, a drain of the first FET receives the third reference voltage, the drain of the second FET receives the fourth reference voltage, the sources of the first FET and the second FET respectively connects to the sixth resistor and the seventh resistor, and then are interconnected to form the output ends of the voltage control circuit coupling with the reference voltage module, and wherein the third reference voltage is larger than the reference voltage, and the reference voltage is larger than the fourth reference voltage.

10. The liquid crystal device as claimed in claim 7, wherein the reference voltage module comprises a fourth resistor and a fifth resistor serially connected, one end of the fourth resistor connects to an output end of the boost circuit, and the other end of the fourth resistor connects to one end of the fifth resistor, the other end of the fifth resistor is electrically grounded, and a reference voltage connects between the fourth resistor and the fifth resistor to cooperatively operates with the fourth resistor and the fifth resistor so as to adjust the output voltage.

11. The liquid crystal device as claimed in claim 10, wherein the fourth resistor and/or the fifth resistor are adjustable resistors.

12. The liquid crystal device as claimed in claim 7, wherein the LED backlight driving circuit further comprises a voltage control module for controlling the boost circuit such that the boost circuit converts the input voltage to the needed output voltage to be provided to the LED string, and the LED string is driven by a constant current.

* * * * *